United States Patent [19]

Stahlecker

[11] Patent Number: 5,044,150

[45] Date of Patent: Sep. 3, 1991

[54] ARRANGEMENT FOR PRODUCING PACKAGES USED AS FEEDING PACKAGES FOR TWISTING

[75] Inventor: Fritz Stahlecker, Bad Uberkingen, Fed. Rep. of Germany

[73] Assignee: Hans Stahlecker, Fed. Rep. of Germany; a part interest

[21] Appl. No.: 624,472

[22] Filed: Dec. 10, 1990

Related U.S. Application Data

[63] Continuation of Ser. No. 361,321, Jun. 5, 1989, abandoned.

[30] Foreign Application Priority Data

Jun. 10, 1988 [DE] Fed. Rep. of Germany ..... 3819858

[51] Int. Cl.[5] ..... D01H 1/20; D01H 13/18

[52] U.S. Cl. ..... 57/328; 57/83; 242/38; 242/42

[58] Field of Search ..... 57/22, 328, 80, 81, 57/83, 84, 86; 242/38, 42

[56] References Cited

U.S. PATENT DOCUMENTS

| | | | |
|---|---|---|---|
| 3,759,026 | 9/1973 | Hope | 57/86 X |
| 4,276,740 | 7/1981 | Chambley et al. | 57/328 X |
| 4,610,132 | 9/1986 | Rohner et al. | 57/22 |
| 4,719,744 | 1/1988 | Morrison | 57/328 X |
| 4,790,130 | 12/1988 | Stahlecker et al. | 57/328 X |
| 4,798,045 | 1/1989 | Bottarelli et al. | 57/261 |
| 4,819,422 | 4/1989 | Stahlecker et al. | 57/328 |

FOREIGN PATENT DOCUMENTS

| | | | |
|---|---|---|---|
| 3634464 | 4/1988 | Fed. Rep. of Germany | 57/328 |

*Primary Examiner*—Joseph J. Hail, III

*Attorney, Agent, or Firm*—Evenson, Wands, Edwards, Lenahan & McKeown

[57] ABSTRACT

In an arrangement for producing packages, which are used as feeding packages for twisting, it is provided that, directly in front of a cross-winding device of a wind-up device, a processing device is arranged which is controlled by yarn detectors. The yarn detectors monitor one yarn resepctively, which together form a double yarn, which is wound on the package. A yarn separating device or a device for connecting the two yarns is used as the processing device.

17 Claims, 2 Drawing Sheets

ARRANGEMENT FOR PRODUCING PACKAGES USED AS FEEDING PACKAGES FOR TWISTING

This is a continuation of application Ser. No. 07/361,321, filed June 5, 19898 now abandoned.

The invention relates to an arrangement for producing packages used as feeding packages for twisting, which contain two yarn components wound up side-by-side. The arrangement includes drafting devices for drawing two slivers into yarn components, prestrengthening devices for the prestrengthening of the drafted yarn components into yarns, guiding devices for guiding together the two yarns to form a double yarn, withdrawing devices for withdrawing the double yarn and winding devices for winding the double yarn on a package. The winding devices contain devices for the cross-winding. Yarn detectors are provided which are arranged behind the prestrengthening devices for the prestrengthening and control a processing device which is assigned to the double yarn.

In the arrangement of my commonly assigned pending U.S. Pat. Application Ser. No. 07/311,731, filed Feb. 17, 1989 now U.S. Pat. No. 4,947,633, the processing device is constructed as a separating device which is arranged in the area in which the double yarn cross-winds. If one of the two yarn components breaks, a cutting of the still existing double yarn takes place so that the two yarns have at least approximately the same length and their ends are located at the same point on the package. As a result, it is possible to find the double yarn by means of an automatic searching device during a piecing and to withdraw it.

In another arrangement disclosed in my commonly assigned Pending U.S. Pat. Application Ser. No. 07/340,708, filed Apr. 20, 1989 now abandoned, if a yarn breaks, the winding up of the double yarn on the package is interrupted, the unbroken yarn being gripped and held at a given point. It can then be picked up at this point by an automatic piecing device. During the withdrawal of the unbroken yarn, the broken yarn is also withdrawn from the package so that also its end is found easily and without any problems. In order to, in the case of this arrangement, facilitate the taking-along of the broken double yarn during a withdrawal from the package, a processing device is provided in the form of a connecting device which is activated by the yarn detectors and which connects the broken yarn component with the unbroken yarn component.

An object of the invention is to increase the effectiveness of the arrangement of the initially mentioned type.

This object is achieved in that the processing device is connected directly in front of the devices for the winding-up, a yarn guide being arranged between the devices for the cross-winding and the processing device.

By means of this construction, the processing device is moved as closely as possible in the direction of the package, so that the largest possible distance is maintained between the yarn detectors and the processing device. In view of the high operating speeds, this distance is advantageous since otherwise there is the risk that, in the time period which a yarn detector requires for the actuating of the processing device, the broken yarn end may already have passed through the area of the processing device. By means of the yarn guide arranged behind the processing device, it is ensured that the double yarn does not cross-wind in the area of the processing device, i.e., that it is continuously located in the area of the processing device, so that this processing device can act upon the double yarn immediately in the case of a corresponding signal.

In a further development of preferred embodiments of the invention, it is provided that the processing device is arranged between a compensating device and the devices for the cross-winding. The compensating device provides that the changes of length in the double yarn are absorbed which occur during the cross-winding movement, without the occurrence of tensions which are unacceptable for the double yarn which is formed of relatively weak yarns. In this case it is contemplated to coordinate the start of the operation of the processing device triggered by one or both yarn detectors with the speed of the double yarn existing between the device for the cross-winding and the compensating device, so that the carrying-out of the separating cut as well as, as an alternative, a connecting of the two yarns can be carried out particularly effectively.

The yarn detectors are connected directly behind the devices for the prestrengthening which are preferably constructed as pneumatic false-twisting devices. In the yarn components, a false twist is generated which opens up when the false-twisting devices are left so that, in this area, the yarns only still have the strength which was caused by the prestrengthening; i.e., they are relatively weak. It is therefore expedient to arrange the yarn detectors directly at the outlet of the false-twisting devices since, on the one hand, this is the area most at risk, while, on the other hand, in this area, a possible yarn breakage can be detected the earliest. Yarn detectors are used preferably which have only a yes-no function; i.e., react to the presence or absence of a yarn. The currently known yarn detectors, which, in addition, have a testing function with respect to the quality, are still relatively slow. If the existing yarn moving path between the yarn detectors and the processing device, in view of the high production speed and the response time of the yarn detectors and/or of the processing device should be too short, it is possible to extend the yarn moving path by means of deflecting guides and to adapt it to the allowed time.

Other objects, advantages and novel features of the present invention will become apparent from the following detailed description of the invention when considered in conjunction with the accompanying drawings.

BRIEF DESCRIPTION OF THE DRAWINGS

FIG. 2 is a view taken in the direction of arrow II of FIG. 1.

DETAILED DESCRIPTION OF THE DRAWINGS

Figure 1:
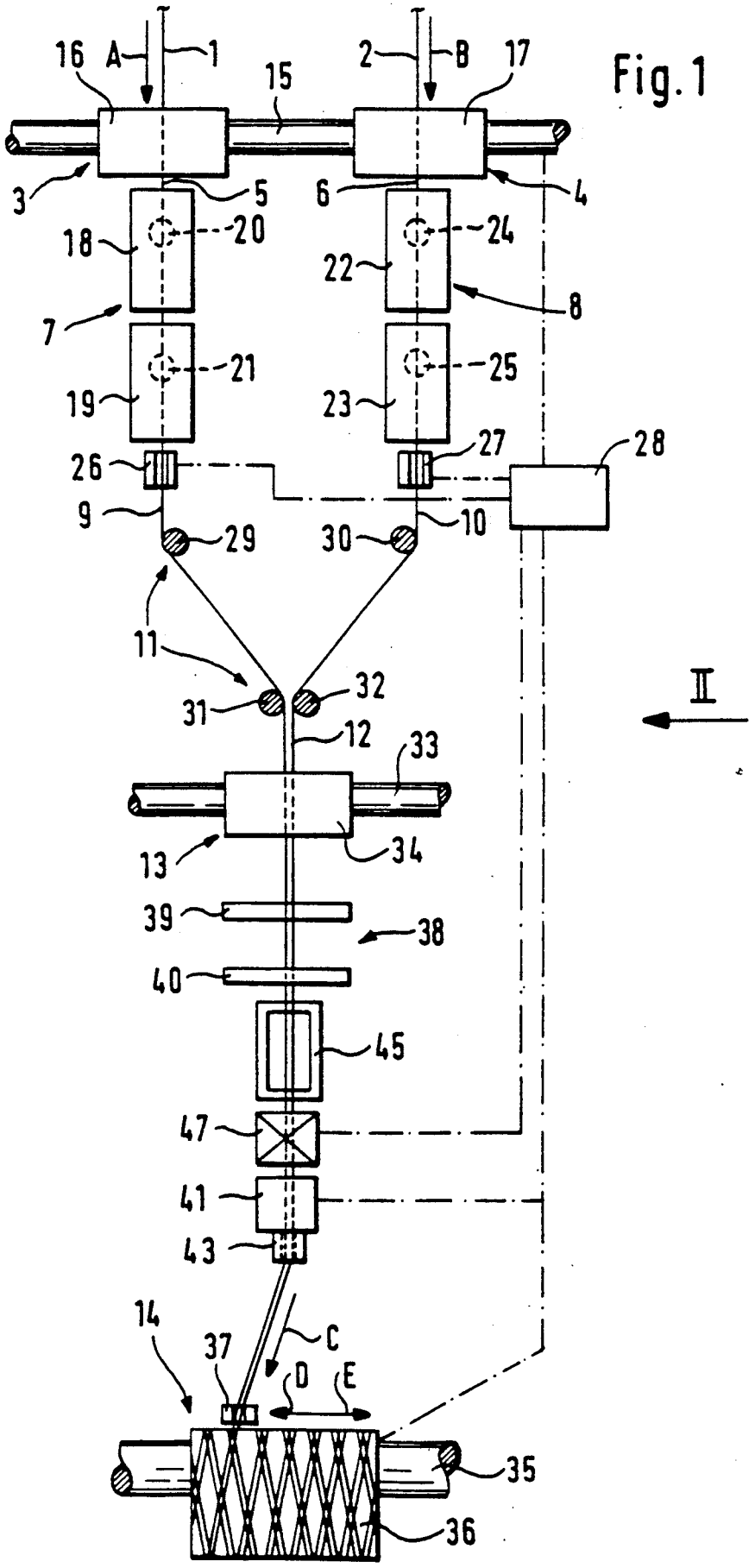
FIG. 1 is a schematic front view of an arrangement constructed according to a preferred embodiment of the invention.
Figure 2A:
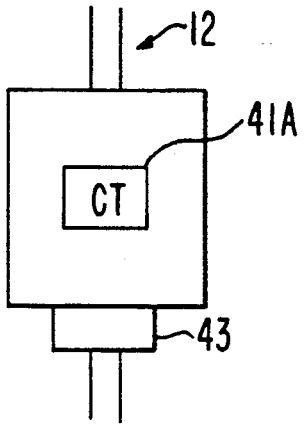
FIG. 2A is a schematic enlarged view depicting a first embodiment of a processing device including a yarn cutting mechanism, for use with the arrangement of FIGS. 1 and 2.
Figure 2B:
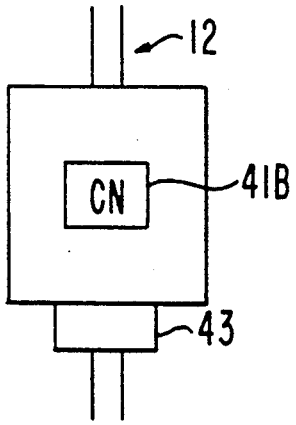
FIG. 2B is a schematic enlarged view depicting a second embodiment of a processing device including a yarn connecting mechanism, for use with the arrangement of FIGS. 1 and 2.
Figure 2C:
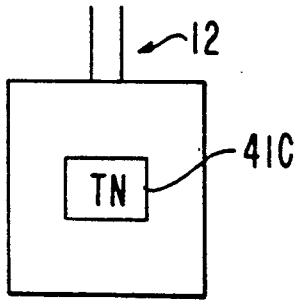
FIG. 2C is a schematic enlarged view depicting a third embodiment of a processing device including a yarn twisting nozzle device, for use with the arrangement of FIGS. 1 and 2.

In FIGS. 1 and 2, an individual spinning point or unit of a machine is shown which consists of a plurality of such spinning units arranged in a row next to one another. At each of these spinning units, two slivers 1, 2 are guided through the drafting units 3, 4 in the direction of the arrows (A, B) and are drawn into yarn components 5, 6 of a desired size. These yarn components 5, 6 enter into pneumatic false-twisting devices 7, 8, in which, by means of pneumatic false twisting, they are spun into relatively slightly prestrengthened yarns 9, 10. By means of yarn guiding elements 11, these yarns 9, 10 are guided together to form a double yarn 12, which is withdrawn by means of a common withdrawal device 13 and moves in the direction of arrow (C) to a wind-up device 14 by which the double yarn 12 is wound up to a cross-wound package 36.

Of the drafting units 3, 4, only the last pair of rollers is shown, which is formed by a common bottom cylinder 15 extending through in the longitudinal direction of the machine and driven at the machine end, and pressure rollers 16, 17. The pressure rollers 16, 17 of the drafting units 3, 4 are constructed as so-called pressure roller twins and are held in a weighting arm which is not shown. The drafting units 3, 4 are constructed with respect to the material to be spun and are, for example, constructed as a three-cylinder drafting unit or as a five-cylinder drafting unit, which are each also equipped with corresponding top aprons and bottom aprons. It is possible to interrupt, in a manner not shown in detail, the operation of the drafting units 3, 4 at an individual spinning unit without stopping the bottom cylinders, of which only bottom cylinder 15 is shown. This may, for example, take place in that the drafting units 3, 4 are equipped with a known sliver stopping device, or in that a mechanism is provided for the lifting of the weighting arm accommodating the pressure roller twins.

The pneumatic false twisting devices 7, 8 consist of two air nozzles 18, 19; 22 23 respectively, which are arranged behind one another and are connected to compressed-air supply pipes 20, 21, 24, 25. The respective first air nozzles 18, 22 are constructed as so-called intake nozzles which apply no or almost no false twist to the entering yarn components 5, 6. The respective second air nozzles 19, 23 are the actual false twisting nozzles.

Yarn detectors 26, 27 are, if possible, disposed directly behind the outlet of the air nozzles 19, 23 and are connected to a control apparatus 28. Even when only one of the two prestrengthened yarns 9, 10 breaks, certain operating steps are triggered which will be explained in the following.

Pin-shaped yarn guides 29, 30, 31, 32 are provided as the yarn guiding elements 11. Yarn guides 29, 30 guide the yarns 9, 10 first as an extension of the air nozzles 19, 23, while yarn guides 31, 32 then guide the yarns 9, 10 together so that they form a double yarn 12. Yarn guides 31, 32 maintain a narrow distance from one another which is such that a double yarn 12 is formed, in which the yarns 9, 10 are, however, held to still be separate from one another as well as possible.

As the withdrawal device 13, a cylinder is provided which extends in the longitudinal direction of the machine and which is driven at the machine end. A pressure roller 34 is assigned to this bottom cylinder 33.

The wind-up device is shown only schematically. It contains a winding shaft 35, which extends through in the longitudinal direction of the machine, is driven at the machine end, and on which the package 36 rests which is held by means of a package frame, which is not shown, this package 36 being driven by the winding roller 35. The wind-up device 14 also contains a cross-winding device, of which one cross-winding yarn guide 37 is shown which is driven back and forth in the direction of the arrows (D and E) for producing a cross-wound package 36.

The changes of length in the double yarn 12, which are created by the cross-winding process at a constant rotational speed of the withdrawal device 13, are compensated by a compensating device 38 which is arranged behind the withdrawal device 13. The compensating device 38 consists of a stationary guiding element 40, in front of which a guiding element 39 is connected which can be moved back and forth in the direction of the arrows (F and G). This guiding element 39 moves synchronously, but phase-shifted with respect to the cross-winding yarn guide 37.

Between the compensating device 38 and the wind-up device 14, a processing device 41 is arranged, the function of which will be explained in the following. At the outlet of the processing device 41, a yarn guide 43 is located so that the cross-winding motion of the double yarn 12 is not transferred back to the area of the processing device 41.

In front of the processing device 41, a yarn testing device 47 is also arranged in the path of the double yarn 12. In addition, a suction device 45 is located between the yarn testing device 47 and the yarn guide 40.

The yarn detectors 26, 27 and the yarn testing device 47, which emit control signals, are connected to the control apparatus 28. In the case of corresponding signals, the control apparatus 28 controls the processing device 41 as well as devices, which are not shown, for interrupting the operation of the drafting units 3, 4. In the drawing, it is indicated by means of a dash-dotted line that the control apparatus 28 is connected with a corresponding device. In addition, the control apparatus 28 is connected with a device, which is not shown, which is applied to the package frame of the package 36, and swivels the package frame in such a manner that the package 36 is lifted off the winding roller 35.

In a first embodiment (see FIG. 2A), it is provided that the processing device 41A contains devices C1 for the cutting of the double yarn 12, such as two blades arranged in the manner of scissors, which can be actuated by means of a solenoid and which are kept apart by means of a spring. During a breakage of one of the two yarns 9, 10 or of both yarns, which is indicated by the yarn detectors 26, 27, the processing device 41A is actuated immediately by means of the control apparatus 28, so that the double yarn 12 is cut before the broken yarn end has passed through the range of the processing device 41A. Thus it is ensured that the ends of both yarns 9, 10 are located next to one another also on the package 36. The control apparatus 28 also controls the drafting units 3, 4 in that, when a yarn breakage is signaled, both drafting units 3, 4 are stopped. In order to prevent that the end of the double yarn 12 is rolled into the package 36 and will then be harder to find, the control apparatus 28 also controls that the package 36 is lifted off the continuously running winding roller 35. In this embodiment, the lifting-off of the package 36 and the interrupting of the operation of the drafting units 3, 4 may take place simultaneously with the actuating of the processing device 41A, but no fixed time relationship has to be provided between these operations.

In another embodiment (FIG. 2B), the processing device 41B contains devices Cn for connecting the two yarns 9, 10 forming the double yarn 12, which are also actuated by means of the control apparatus 28. Here also, in the case of the breakage of one of the yarns 9, 10, by means of the control apparatus 28, the actuating of the processing device 41B is triggered. For example, the processing device 41B contains a twisting nozzle, by means of which a false twist is generated in the double yarn 12, in which case the broken yarn is wound around the unbroken yarn, so that a connection is established between the two yarns 9, 10. In another embodiment (FIG. 2C), a type of splicing chamber Tn is provided in the processing device 41C, by the actuating of which the fibers of both yarns 9, 10 of the double yarn 12 are mixed with one another and possibly are also twisted together with one another, so that a connection is established.

As mentioned above, when one of the yarns 9 or 10 breaks, the processing device 41 is actuated by means of the control apparatus 28 and establishes a connection between the two yarns 9,10. Simultaneously, the drive of the package 36 is interrupted by means of the control apparatus 36. The package 36 will then come to a stop with a certain time delay. Taking into account this time delay and/or by means of sensing of rotational speed of the package 36, the control apparatus 28 controls an interruption of the operation of the drafting units 3, 4 in such a manner that, approximately at a point in time when the package 36 comes to a stop, the operation of the drafting units 3, 4 is cancelled. No additional yarn components 5, 6 will then be fed, so that these break and the hitherto not yet broken yarn 9 or 10 is withdrawn by means of the withdrawal device 13. This yarn 9 or 10 will then be taken in by the suction device 45, which expediently is not operating continuously, but is also actuated by the control apparatus 28. Since the withdrawal device 13 continues to operate, the yarn 9 or 10, which continues to move at the same speed when the package 36 is slowed down, is sucked into the suction device 45 first in a loop shape and later in a straight shape. This yarn 9 or 10 will then be in a position, in which it can easily be gripped by a corresponding device of a piecing apparatus. It will then be possible, by means of this yarn, to wind a given length of double yarn 12 off the package 36, in which case, as a result of the established connection between the two yarns 9, 10, the respective broken yarn is taken along securely.

In a third embodiment, the processing device 41 is equipped with devices for connecting the two yarns 9, 10 of the double yarn 12 as well as with devices for cutting the double yarn 12. In this case, when one yarn 9 or 10 breaks, the devices for the connecting are actuated first, whereas the devices for the cutting are actuated immediately afterwards. It will then be ensured that the last end of the double yarn 12 wound onto the package 36 consists of yarns 9, 10 which are connected with one another, so that the devices for the searching and withdrawing of the double yarn 12 of an automatic piecing apparatus also securely grip and take along the double yarn 12 and not only an individual yarn.

The yarn testing device 47 is also connected to the control apparatus 28. The yarn testing device 47 is a quality testing device which examines the double yarn 12 with respect to such defects which can no longer be tolerated in the twisted yarn produced from the double yarn 12. The yarn testing device 47 will then emit a signal to the control apparatus 28. The control apparatus 28 can then trigger a stopping of the corresponding spinning point in one of the manners discussed above. Also in this case, it is provided that the two yarns 9, 10 of the double yarn 12 are located at approximately the same point on the package 36 and/or that the two yarns 9, 10 of the double yarn 12 are connected with one another. Likewise, it is also possible to stop the spinning point, without actuating the processing device, in the above-described manner, such that the double yarn 12 is then held by the suction device 45.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An arrangement for producing packages used as feeding packages for twisting and having two yarn components which are wound up side-by-side comprising:

drafting means for drafting the two yarn components, prestrengthening means for prestrengthening the drafted yarn components, guiding means for guiding together the two yarn components to form a double yarn, withdrawing means for withdrawing the double yarn, winding means including cross-winding means for cross-winding the double yarn on a package, yarn component detection means arranged behind the prestrengthening means for detecting the respective yarn components, and processing device means for processing the double yarn in such a manner as to assure disposition of the two yarn ends in position for a subsequent separate piecing operation involving locating and returning the two yarn ends to a piecing apparatus other than the processing device means, wherein the processing device means is disposed at a position substantially spaced from the detection means and directly in front of the winding means to thereby lengthen the time period for a broken yarn end to travel between the detection means and the processing device means, and wherein a yarn guide is arranged between the cross-winding means and the processing device means to limit cross-winding in the area of the processing device means.

2. An arrangement according to claim 1, wherein the processing device means is arranged between a yarn length compensating device and the cross-winding means.

3. An arrangement according to claim 2, wherein a suction device is arranged between the processing device means and the compensating device, said suction device being actuable by the yarn component detectors means.

4. An arrangement according to claim 3, wherein a yarn testing device for the double yarn is connected in front of the processing device means.

5. An arrangement according to claim 3, wherein the processing device means is equipped with devices for cutting the double yarn.

6. An arrangement according to claim 3, wherein the processing device means is equipped with devices for connecting the two yarns.

7. An arrangement according to claim 2, wherein a yarn testing device for the double yarn is connected in front of the processing device means.

8. An arrangement according to claim 2, wherein the processing device means is equipped with devices for cutting the double yarn.

9. An arrangement according to claim 2, wherein the processing device means is equipped with devices for connecting the two yarns.

10. An arrangement according to claim 1, wherein a yarn testing device for the double yarn is connected in front of the processing device means.

11. An arrangement according to claim 10, wherein the processing device means is equipped with devices for cutting the double yarn.

12. An arrangement according to claim 11, wherein the processing device means contains a pneumatic twisting nozzle.

13. An arrangement according to claim 10, wherein the processing device means is equipped with devices for connecting the two yarns.

14. An arrangement according to claim 1, wherein the processing device means is equipped with devices for cutting the double yarn.

15. An arrangement according to claim 14, wherein the processing device means contains a pneumatic twisting nozzle.

16. An arrangement according to claim 1, wherein the processing device means is equipped with devices for connecting the two yarns.

17. An arrangement according to claim 16, wherein the processing device means contains a pneumatic twisting nozzle.

* * * * *